US010815713B1

(12) United States Patent
Pittella

(10) Patent No.: US 10,815,713 B1
(45) Date of Patent: Oct. 27, 2020

(54) CLAMPING BAR ARM FOR CONCEALED DOOR CLOSER

(71) Applicant: Joseph A. Pittella, St. James, NY (US)

(72) Inventor: Joseph A. Pittella, St. James, NY (US)

( * ) Notice: Subject to any disclaimer, the term of this patent is extended or adjusted under 35 U.S.C. 154(b) by 0 days.

(21) Appl. No.: 16/516,297

(22) Filed: Jul. 19, 2019

(51) Int. Cl.
*E05F 3/00* (2006.01)
*E05F 3/22* (2006.01)

(52) U.S. Cl.
CPC ..... *E05F 3/227* (2013.01); *E05Y 2600/41* (2013.01); *E05Y 2600/46* (2013.01); *E05Y 2900/132* (2013.01)

(58) Field of Classification Search
CPC ..... E05F 1/1253; E05F 1/1246; E05F 1/129; E05F 3/104; E05F 3/10; E05F 3/20; E05F 3/225; E05F 3/227; E05Y 2201/638; E05Y 2800/268; E05Y 2900/132; E05Y 2600/452; E05Y 2600/41; E05Y 2600/46; E05D 7/04; E05D 7/081; E05D 7/084; E05D 7/086; E05D 7/10; E05D 11/104; E05D 11/1064; Y10T 16/552; Y10T 16/5525; Y10T 16/56; Y10T 16/593; Y10T 16/2769; Y10T 16/2771; Y10T 16/2774; Y10T 16/283; Y10T 16/304; Y10T 16/53826; Y10T 16/53836; Y10T 16/5384; Y10T 16/53848
See application file for complete search history.

(56) References Cited

U.S. PATENT DOCUMENTS 2,603,818 A * 7/1952 Carlson ..... E05F 3/226 16/55
2,770,004 A * 11/1956 Carison ..... E05F 3/00 16/55
3,148,407 A * 9/1964 Glasbrenner ..... E05D 7/081 16/236
3,449,789 A * 6/1969 Russell ..... E05F 3/104 16/55
3,828,394 A * 8/1974 Horgan, Jr. ..... E05D 7/081 16/241

(Continued)

FOREIGN PATENT DOCUMENTS

CN 202850714 U * 4/2013 ..... E05F 3/00
EP 2345788 A2 * 7/2011 ..... E05D 7/0027
GB 1274153 A * 5/1972 ..... E05F 3/00

OTHER PUBLICATIONS

Dorma of Ennepetal, Germany: Overhead Concealed Door Closer, part No. RTS88 Brochure.

*Primary Examiner* — Chuck Y Mah
(74) *Attorney, Agent, or Firm* — Donald J. Ersler

(57) ABSTRACT

A clamping bar arm for a concealed door closer preferably includes a mounting base, an adjustment arm, a clamp block, a pair of clamp fasteners and a pair of adjustment fasteners. The mounting base includes a mounting plate and an adjustment extension. The pair of adjustment fasteners are threaded through the adjustment extension. A pivot pin is inserted into a top of the adjustment extension. The adjustment arm includes a clamp arm and a stop projection, which extends downward from one end of the adjustment arm. A closer spindle notch is formed in an opposing end of the clamp arm to receive a closer spindle of a concealed closer. The clamp block is secured to an opposing end of the adjustment arm with a pair of clamp fasteners. An adjustment pivot hole is formed through the clamp arm to receive the pivot pin.

11 Claims, 4 Drawing Sheets

(56) References Cited

U.S. PATENT DOCUMENTS

| | | | | | |
|---|---|---|---|---|---|
| 3,964,207 | A * | 6/1976 | Peterson | E05D 7/081 | 49/388 |
| 4,109,346 | A * | 8/1978 | Strozier | E05D 7/0027 | 16/235 |
| 4,646,472 | A * | 3/1987 | Sugawara | E05F 1/123 | 16/238 |
| 4,696,078 | A * | 9/1987 | Stromquist | E05F 1/123 | 16/301 |
| 5,203,115 | A * | 4/1993 | Marinoni | E05D 5/0246 | 16/236 |
| 5,483,770 | A * | 1/1996 | Marinoni | E05D 7/0423 | 16/229 |
| 6,609,335 | B1 * | 8/2003 | Hyakkoku | E05D 7/0415 | 49/388 |
| 7,497,050 | B2 * | 3/2009 | Romero | E05D 15/0626 | 49/141 |
| 8,511,768 | B2 * | 8/2013 | Brachert | E05D 7/04 | 312/405 |
| 8,528,169 | B1 * | 9/2013 | Yu | E05D 7/043 | 16/51 |
| 8,578,556 | B1 * | 11/2013 | Yu | E05F 3/104 | 16/53 |
| 2013/0185896 | A1 * | 7/2013 | Yu | E05F 3/226 | 16/55 |
| 2017/0198507 | A1 * | 7/2017 | Humble | E05D 7/0423 | |
| 2019/0195010 | A1 * | 6/2019 | Yu | E05F 3/226 | |
| 2019/0383072 | A1 * | 12/2019 | Rodriguez Rodriguez | F16C 11/04 | |

* cited by examiner

CLAMPING BAR ARM FOR CONCEALED DOOR CLOSER

BACKGROUND OF THE INVENTION

1. Field of the Invention

The present invention relates generally to doors and more specifically to a clamping bar arm for a concealed door closer, which provides efficient and improved adjustment of an opening angle of a concealed swing door and to adjust from an edge of the door.

2. Discussion of the Prior Art

Dorma of Ennepetal, Germany manufactures an overhead concealed door closer having part no. RTS88. However, a limit arm used in the RTS88, does not offer optimal adjustment of an opening angle of the concealed door.

Accordingly, there is a clearly felt need in the art for a clamping bar arm for a concealed door closer, which provides efficient and improved adjustment of an opening angle of a concealed swing door and an end edge adjustment.

SUMMARY OF THE INVENTION

The present invention provides a clamping bar arm for a concealed door closer, which provides efficient and improved adjustment of an opening angle of a concealed swing door. The clamping bar arm for a concealed door closer (clamping bar arm) preferably includes a mounting base, an adjustment arm, a clamp block, a pair of clamp fasteners and a pair of adjustment fasteners. The mounting base includes a mounting plate and an adjustment extension. The adjustment extension extends upward from a top and middle of the mounting base. A pair of mounting holes are formed through the mounting plate. A pair of adjustment threaded holes are formed through the adjustment extension and are parallel to a length of the mounting base. The pair of adjustment fasteners are threaded into the pair of adjustment threaded holes. A pivot hole is formed into a top of the adjustment extension and is perpendicular to a length of the base plate. A pivot pin is inserted into the pivot hole. The adjustment arm includes a clamp arm and a stop projection. The stop projection extends downward from one end of the adjustment arm. A closer spindle notch is formed in an opposing end of the clamp arm to receive a closer spindle of a concealed closer. A pair of clamp threaded holes are formed on opposing sides of the closer spindle notch and parallel to a length of the clamp arm to receive the pair of clamp fasteners. A pair of clamp holes are formed through the clamp block. An adjustment pivot hole is formed through the clamp arm, adjacent the closer spindle notch. The pivot hole is sized to receive the pivot pin.

In use, the mounting base is placed in a top rail of a swing door. The pivot hole of the adjustment arm is pushed over the pivot pin of the mounting base. The closer spindle of a Dorma concealed closer is inserted into closer spindle notch of the adjustment arm. The pair of clamp fasteners are inserted through the pair of clamp holes in the clamp block and threaded into the pair of clamp threaded holes in the adjustment arm to secure the adjustment arm to the closer spindle. The pair of adjustment fasteners are threaded into the pair of adjustment thread holes formed through the mounting base. A pair of mounting fasteners are inserted through the pair of mounting holes in the mounting plate of the mounting base. The pair of mounting fasteners are threaded into a top of a swing door. The pair of adjustment fasteners are rotated to adjust an opening angle of the swing door, which allows the adjustment arm to pivot relative to the mounting base from an edge of the door stile.

Accordingly, it is an object of the present invention to provide a clamping bar arm for a concealed door closer, which provides efficient and improved adjustment of the opening angle of a concealed swing door.

These and additional objects, advantages, features and benefits of the present invention will become apparent from the following specification.

DETAILED DESCRIPTION OF THE PREFERRED EMBODIMENTS

Figure 1:
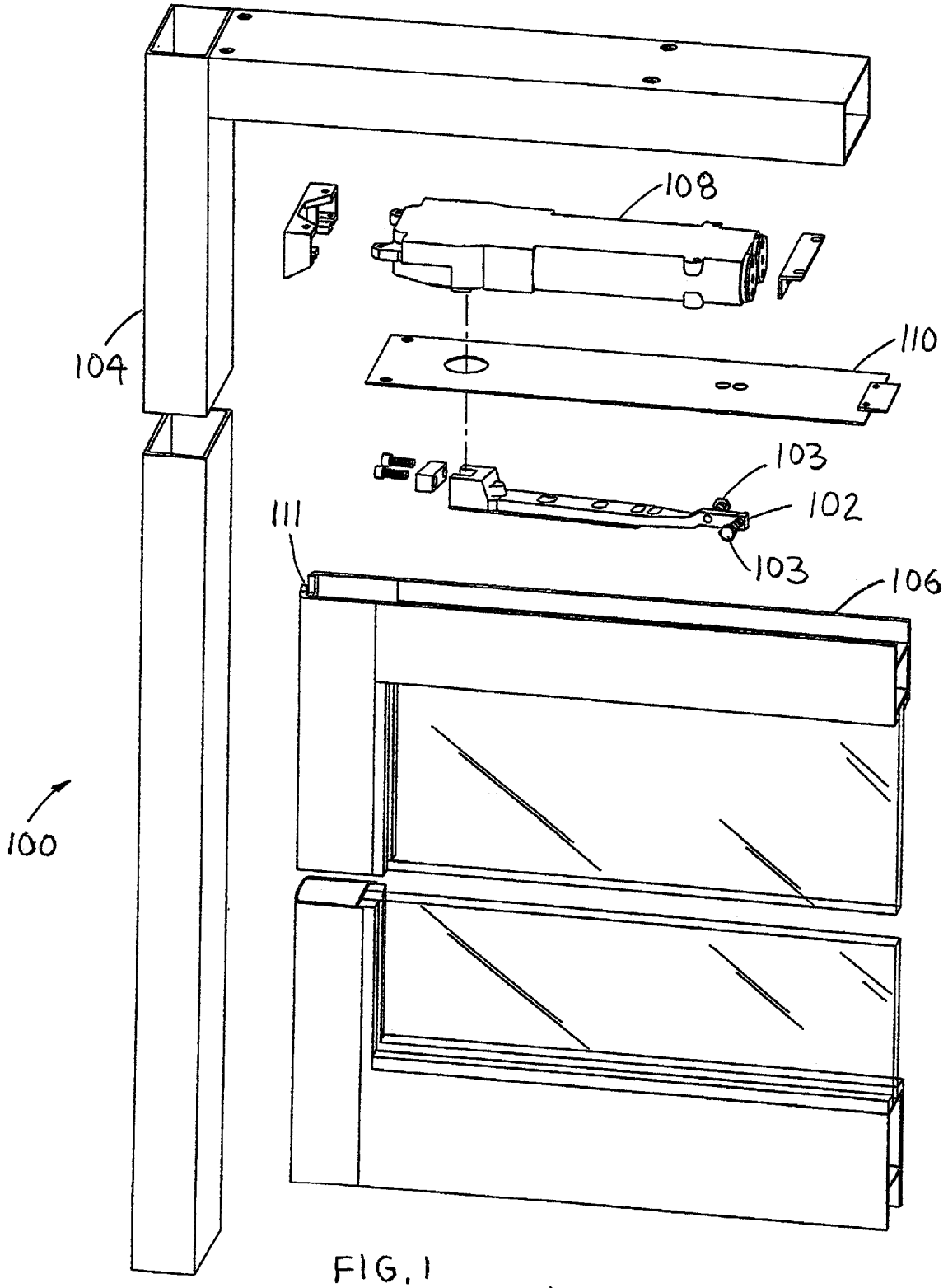
FIG. 1 (PRIOR ART)
FIG. 1 is a partially exploded perspective view of a swing door with a Dorma concealed door closer.
Figure 2:
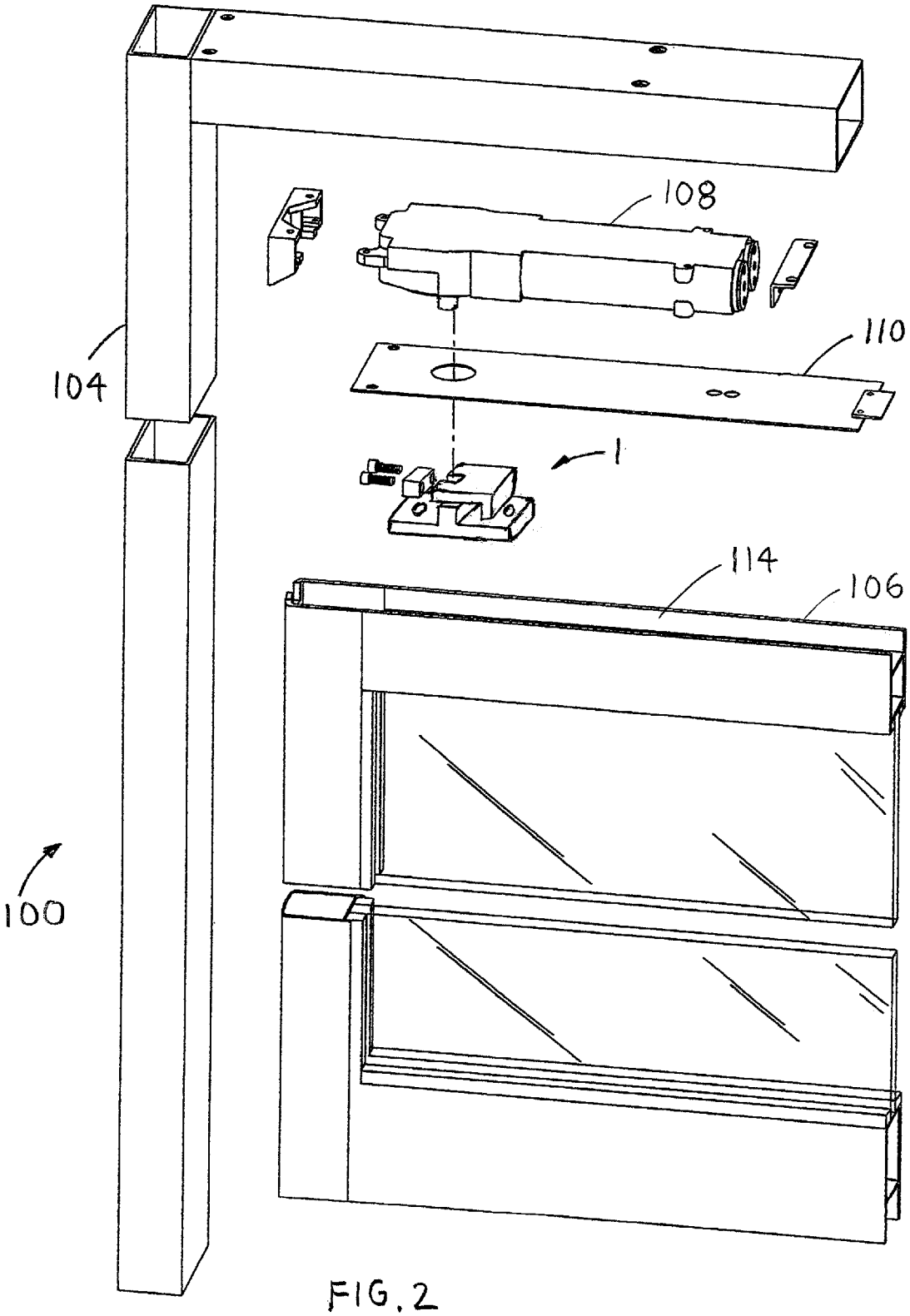
FIG. 2 is a partially exploded perspective view of a swing door with a Dorma limit arm replaced with a clamping bar arm in accordance with the present invention.
Figure 3:
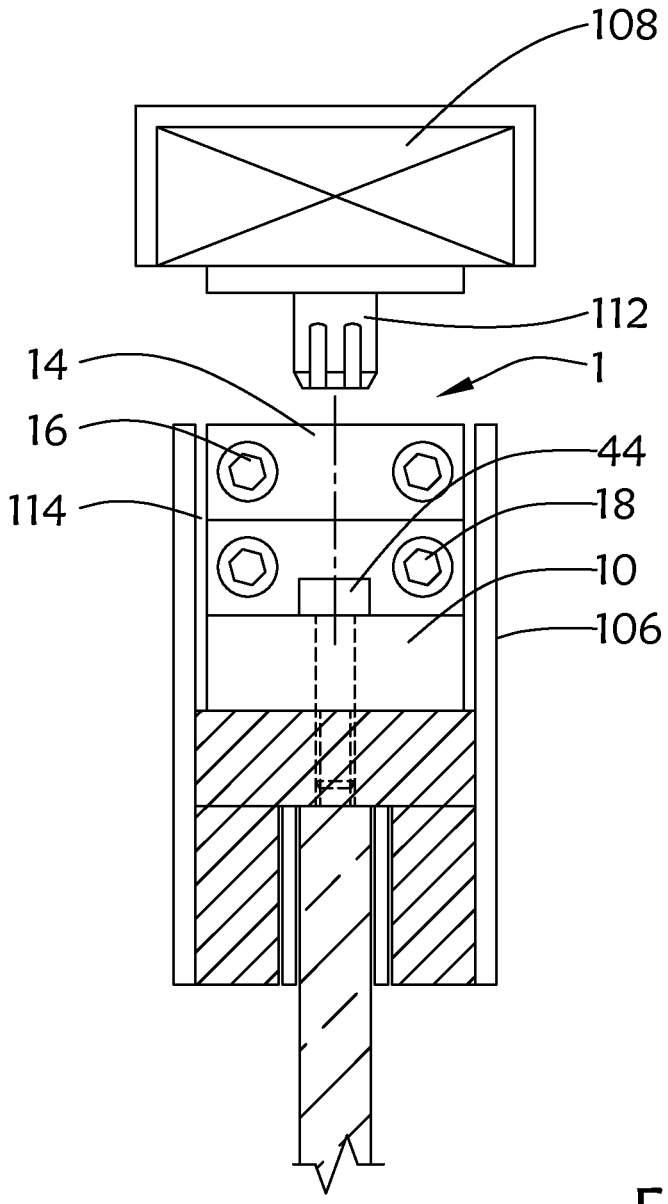
FIG. 3 is a cross sectional view of a portion of a swing door having a Dorma limit arm replaced with a clamping bar arm in accordance with the present invention.
Figure 4:
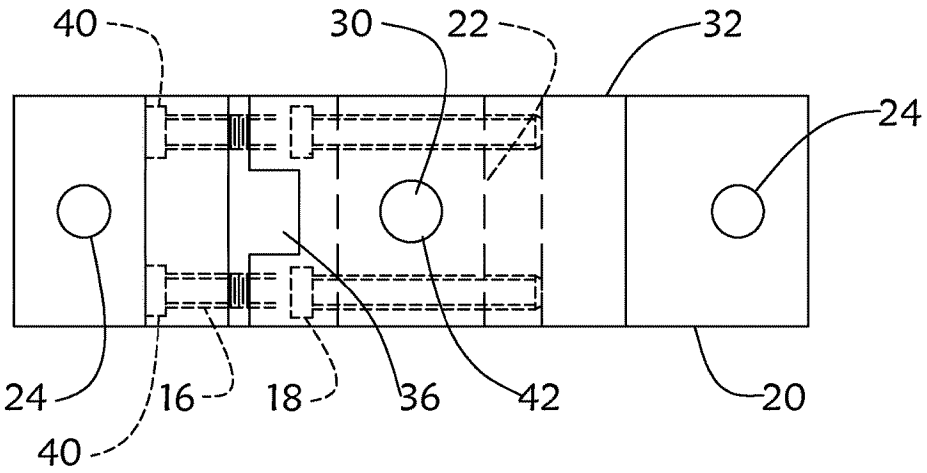
FIG. 4 is a top view of a clamping bar arm in accordance with the present invention.
Figure 5:
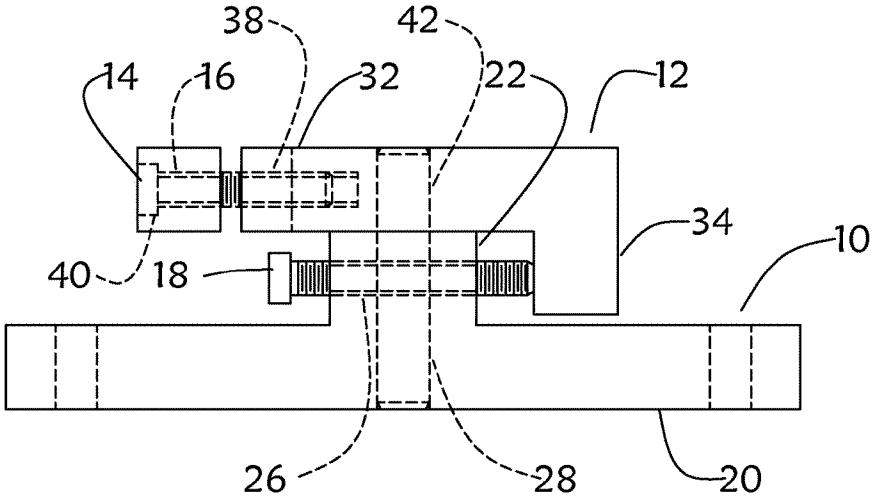
FIG. 5 is a side view of a clamping bar arm in accordance with the present invention.

With reference now to the drawings, and particularly to FIG. 1, there is shown a partially exploded perspective view of a swing door 100 with a Dorma concealed closer 108. The swing door 100 includes a door frame 104 and a swing door 106. A limit arm 102 and a cover plate 110 are included with the Dorma concealed closer 108. An adjustment notch 111 is formed in a top end of the swing door 106. With reference to FIG. 2, the limit arm 102 is replaced with a clamping bar arm 1. With reference to FIGS. 3-5, the clamping bar arm 1 preferably includes a mounting base 10, an adjustment arm 12, a clamp block 14, a pair of clamp fasteners 16 and a pair of adjustment fasteners 18. The mounting base 10 includes a mounting plate 20 and an adjustment extension 22. The adjustment extension 22 extends upward from a top of the mounting base 20. A pair of mounting holes 24 are formed through the mounting plate 20. A pair of adjustment threaded holes 26 are formed through adjustment extension 22 and are parallel to a length of the mounting base 20. The pair of adjustment fasteners 18 are threaded into the pair of adjustment threaded holes 26. A pivot hole 28 is formed into a top of the adjustment extension 22 and is perpendicular to a length of the base plate 10. A pivot pin 30 is inserted into the pivot hole 28. The adjustment arm 12 includes a clamp arm 32 and a stop projection 34. The stop projection 34 extends downward from one end of the clamp arm 32. A closer spindle notch 36 is formed in an opposing end of the clamp arm 32 to receive a closer spindle 112 of the concealed closer 108. A pair of clamp threaded holes 38 are formed on opposing sides of the closer spindle notch 36 and parallel to a length of the clamp arm 32 to receive the pair of clamp fasteners 16. A pair of clamp holes 40 are formed through the clamp block 14. An adjustment pivot hole 42 is formed through the clamp arm 32, adjacent the closer spindle notch 36. The pivot hole 42 is sized to receive the pivot pin 30.

In use, the mounting base 10 is placed in a top rail 114 of a swing door 106. The pivot hole 42 of the adjustment arm 12 is pushed over the pivot pin 30 of in the mounting base

10. The closer spindle 112 of the Dorma concealed closer 108 is inserted into closer spindle notch 36 of the adjustment arm 12. The pair of clamp fasteners 16 are inserted through the pair of clamp holes 40 in the clamp block 14 and threaded into the pair of clamp threaded holes 38 in the adjustment arm 12 to secure the adjustment arm 12 to the closer spindle 112. The pair of adjustment fasteners 18 are threaded into the pair of adjustment thread holes 26 formed through the adjustment extension 22. The position of the pair of adjustment fasteners 18 shown in FIG. 5, would not allow pivoting of the adjustment arm 12 relative to the adjustment base 10. With reference to FIG. 3, a pair of mounting fasteners 44 are inserted through the pair of mounting holes 24 in the mounting plate 20. The pair of mounting fasteners 44 are threaded into a top of a swing door 106. The pair of adjustment fasteners 18 are rotated to adjust an opening angle of the swing door 106, which allows the adjustment arm 12 to pivot relative to the mounting base 10. With reference to FIG. 2, the pair of adjustment fasteners 18 are accessed through the adjustment notch 111. With reference to FIG. 1, Dorma requires the adjustment of the opening angle to be made from a top of the swing door 106 with two fasteners 103 of the limit arm 102.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A clamping bar arm for a concealed door closer, the concealed door closer includes a closer spindle, comprising:

a mounting base includes a mounting plate and an adjustment extension, said adjustment extension extends upward from a top of said mounting plate; and an adjustment arm includes a clamp arm and a stop projection, said stop projection extends downward from one end of said clamp arm, a closer spindle notch is formed in an opposing end of said clamp arm to receive a closer spindle of a concealed door closer, wherein said adjustment arm is pivotally retained relative to said mounting base.

2. The clamping bar arm for a concealed door closer, the concealed door closer includes a closer spindle of claim 1, further comprising:

a pivot pin is retained in said adjustment extension and said clamp arm.

3. The clamping bar arm for a concealed door closer, the concealed door closer includes a closer spindle of claim 1 wherein:

a pair of mounting holes are formed through said mounting plate.

4. A clamping bar arm for a concealed door closer, the concealed door closer includes a closer spindle, comprising:

a mounting base includes a mounting plate and an adjustment extension, said adjustment extension extends upward from a top of said mounting plate;

an adjustment arm includes a clamp arm and a stop projection, said stop projection extends downward from one end of said clamp arm, a closer spindle notch is formed in an opposing end of said clamp arm to receive a closer spindle of a concealed door closer, wherein said adjustment arm is pivotally retained relative to said mounting base; and a clamp block for securing the closer spindle in the closer spindle notch.

5. The clamping bar arm for a concealed door closer, the concealed door closer includes a closer spindle of claim 4, further comprising:

a pivot pin is retained in said adjustment extension and said clamp arm.

6. The clamping bar arm for a concealed door closer, the concealed door closer includes a closer spindle of claim 4 wherein:

a pair of mounting holes are formed through said mounting plate.

7. The clamping bar arm for a concealed door closer, the concealed door closer includes a closer spindle of claim 4 wherein:

a pair of clamp screws are inserted through said clamp block and threaded into said opposing end of said clamp arm.

8. A clamping bar arm for a concealed door closer, the concealed door closer includes a closer spindle, comprising:

a mounting base includes a mounting plate and an adjustment extension, said adjustment extension extends upward from a top of said mounting plate;

a pair of adjustment screws are threaded into said adjustment extension;

an adjustment arm includes a clamp arm and a stop projection, said stop projection extends downward from one end of said clamp arm, a closer spindle notch is formed in an opposing end of said clamp arm to receive a closer spindle of a concealed door closer, wherein said pair of adjustment screws are rotated to set a pivot angle, wherein said adjustment arm is pivotally engaged with said mounting base; and a clamp block for securing the closer spindle in the closer spindle notch.

9. The clamping bar arm for a concealed door closer, the concealed door closer includes a closer spindle of claim 8, further comprising:

a pivot pin is retained in said adjustment extension and said clamp arm.

10. The clamping bar arm for a concealed door closer, the concealed door closer includes a closer spindle of claim 8 wherein:

a pair of mounting holes are formed through said mounting plate.

11. The clamping bar arm for a concealed door closer, the concealed door closer includes a closer spindle of claim 8 wherein:

a pair of clamp screws are inserted through said clamp block and threaded into said opposing end of said clamp arm.

* * * * *